US007703218B2

(12) United States Patent
Burgess

(10) Patent No.: US 7,703,218 B2
(45) Date of Patent: Apr. 27, 2010

(54) TRACTION DEVICE

(76) Inventor: Richard C. Burgess, P.O. Box 112, Charlestown, NH (US) 03603

( * ) Notice: Subject to any disclaimer, the term of this patent is extended or adjusted under 35 U.S.C. 154(b) by 897 days.

(21) Appl. No.: 11/470,794

(22) Filed: Sep. 7, 2006

(65) Prior Publication Data

US 2007/0056187 A1 Mar. 15, 2007

Related U.S. Application Data

(60) Provisional application No. 60/716,832, filed on Sep. 14, 2005.

(51) Int. Cl.
*A43B 3/10* (2006.01)
*A43C 11/00* (2006.01)
*A43C 15/00* (2006.01)

(52) U.S. Cl. ..... 36/7.6; 36/50.1; 36/9 R

(58) Field of Classification Search ..... 36/7.1 R, 36/7.3, 7.5, 7.6, 9 R, 122–125, 7.1 A, 7.7, 36/58.5, 58.6, 62; 24/712, 713.3, 713.4, 24/714.6

See application file for complete search history.

(56) References Cited

U.S. PATENT DOCUMENTS

| | | | | |
|---|---|---|---|---|
| 1,187,778 | A | | 6/1916 | Paskett |
| 2,538,182 | A | | 1/1951 | Young |
| 2,628,437 | A | | 2/1953 | Forsythe |
| 2,685,141 | A | | 8/1954 | Davenport |
| 2,726,461 | A | * | 12/1955 | Smith ..... 36/7.6 |
| 2,801,478 | A | | 8/1957 | Gilbert |
| 3,019,533 | A | | 2/1962 | Smith |
| 3,021,617 | A | | 2/1962 | Koch |
| 3,099,885 | A | | 8/1963 | Jordan et al. |
| 4,635,383 | A | * | 1/1987 | Free ..... 36/7.6 |
| 4,897,935 | A | * | 2/1990 | Fel ..... 36/7.7 |
| 5,150,536 | A | | 9/1992 | Strong |
| 5,359,789 | A | | 11/1994 | Bell |
| 5,463,823 | A | | 11/1995 | Bell et al. |
| 5,535,529 | A | | 7/1996 | Panteah |
| 5,794,360 | A | | 8/1998 | Bell et al. |
| 5,836,090 | A | * | 11/1998 | Smith ..... 36/7.6 |
| 2003/0226281 | A1 | | 12/2003 | Carlton |

* cited by examiner

*Primary Examiner*—Mickey Yu
*Assistant Examiner*—Sharon M Prange
(74) *Attorney, Agent, or Firm*—Michael J. Weins; Jeffrey E. Semprebon

(57) ABSTRACT

A traction device for a boot has a felt platform with a toe section and a heel section, and a heel extension attached to the heel section. Cording passes through two pairs of passages in each of the toe section and the heel extension. On each side, the cording passing from a toe section passage to a heel extension passage forms a side stringer, and the cord extending beyond the heel extension forms a cord extension segment. Loops are provided on each side stringer, and the cord extension segments are each passed through one of the loops before being cinched to tighten the cording against the boot. Preferably, a single length of cord is employed and the loops are tied into the side stringers. It is also preferred for the toe section passages to be positioned on ear extensions that protrude from a body of the felt platform.

13 Claims, 4 Drawing Sheets

TRACTION DEVICE

FIELD OF THE INVENTION

The present invention relates to a device which can be secured to a conventional shoe or boot to cover the sole thereof in order to improve traction on slippery surfaces.

BACKGROUND OF THE INVENTION

It has long been known to attach an auxiliary sole or slipper onto footwear so as to change the characteristic of the sole of the footwear. Most commonly, the auxiliary device provides additional traction on slippery surfaces such as ice or wet rocks. For ice, such devices frequently employ downward-protruding cleats or caulks to provide greater traction; however, such devices are not effective on wet rocks. One material which has classically been used for providing traction on wet rocks is felt, such as taught in U.S. Pat. No. 3,099,885. Auxiliary felt soles which can be attached to conventional footwear as needed are taught in U.S. Pat. Nos. 1,187,778 and 5,150,536. Auxiliary soles having a cushion material such as felt may also be employed to provide a quieter footstep for hunting or wildlife photography, as taught in U.S. Pat. No. 5,535,529 and U.S. Publication No. 2003/0226281. These auxiliary devices may employ a flat sole portion in combination with a binding structure having a toe-retaining structure and a heel/ankle-retaining structure that serve to secure the sole to the conventional shoe or boot of the wearer, as taught in the '778 patent and in the '281 publication. Alternatively, these devices may employ a moccasin-like structure which wraps around the shoe or boot and is secured by straps or laces, as taught in the '529 and '536 patents. While such devices may be effective for limited use on relatively flat surfaces, such as ice, the bindings may not provide sufficient stability for extended use on inclined surfaces, such as when hiking on rocky terrain. Furthermore, such devices are frequently complicated in structure, making them expensive to fabricate and/or difficult to attach to and detach from the footwear.

Auxiliary soles can also be employed to protect the sole of a boot, such as taught in U.S. Pat. No. 2,801,478, which teaches a protective sole to be attached to a caulked boot such as worn by loggers. The sole both protects the caulks from wear and protects floor surfaces from being damaged by the caulks.

Thus, there is a need for an auxiliary traction device for attachment to a boot or shoe which is simple, compact, and lightweight in structure, yet which attaches readily and securely to the boot or shoe and provides sufficient stability for use on inclined surfaces. With current ski-boot technology, protection of ski boots has become a concern. Since the engagement of the sole of the boot with the binding can affect performance, it is important to avoid wear or damage to the sole of the ski boot. Additionally, since the soles of such boots are typically of stiff, noncompliant material, they provide very little traction. Thus, it is desirable for the sole to be covered when the boot is released from the ski binding. In addition to being easily attachable and detachable, the device for covering the sole should be compact and lightweight so as to be readily carried by the skier.

SUMMARY OF THE INVENTION

The present intention relates to a traction device for attachment to a boot or shoe (hereinafter, the term "boot" will be used to represent boots, shoes, and similar footwear) that increases the traction afforded the wearer of the boot. The device is designed to be used on boots which have a sole section and an upper section. The sole section has an arch region for the support of the arch of the wearer. The sole section is bounded by an inner edge and an outer edge. The inner edge, in part, bounds the arch region of the sole section with the result that, when a pair of boots is worn, the inner edges will be opposed, residing between the outer edges. The upper section of the boot has a toe region and a heel region, with an instep region located therebetween and residing above the arch region of the sole section.

The traction device of the present invention is provided with a felt platform which has a body that terminates in a toe section and a heel section, and is configured such that the sole section of the boot can substantially reside on the body.

The toe section has a first pair of toe section passages and a second pair of toe section passages therethrough. The toe passages in each of the pairs are spaced apart such that the toe region of the boot can substantially reside therebetween.

In one preferred embodiment, ear extensions are provided, which serve as outriggers to the toe section of the felt platform. These ear extensions preferably extend between about 1" to 1½" from the body of the platform to assure that the toe section passages will reside above the sole section of the boot.

A heel extension attaches to the heel section of the felt platform and extends therefrom a sufficient distance that it can be folded so as to bring it in contact with the heel region of the upper section of the boot. The heel extension has a first and a second pair of heel extension passages, each of the pairs being spaced apart sufficiently that the heel region of the boot will substantially reside therebetween.

Cording is provided, which is sized so that it can be threaded through the toe section passages and the heel extension passages. When so threaded, the cording in combination with the toe section of the felt platform creates a toe lashing and in combination with the heel extension forms a heel sling. The cording in turn is threaded through the passages so as to create a pair of substantially parallel cord segments which form side stringers, each of which extends between one of the toe section passages and one of the heel extension passages. The cording is then threaded through another heel extension passage on each side and thereafter forms a pair of cord extension segments. Each of the side stringers has a loop formed thereon through which one of the cord extension segments passes. The loops are positioned such that they reside beside the instep region of the boot, and preferably are positioned rearward of the toe lashing about ⅓ of the length of the side stringer. The loops are preferably formed by tying them into the side stringers of the cording.

Means for cinching the cord extension segments between the loops so as to maintain a downward pressure on the instep region of the boot are provided. One simple means for cinching is to tie the cord extensions segments together. A more preferred means is to employ a cordlock that lockably, releasably engages both the cord segments.

In a preferred embodiment, where the traction device is designed to attach to a hiking boot, the felt platform and the heel extension are shaped to better conform to the contour of the upper section of the boot. For this embodiment, the heel section and the heel extension are symmetrically disposed about a heel and heel extension axis, while the toe section is disposed about a toe section axis which is tilted with respect to the heel and heel extension axis by an angle $\Phi$ so as to cant the toe section toward the inner edge of the sole section of the boot. This tilt of the toe section axis assures that, when the toe region of the boot is centered on the toe section of the felt platform, the heel region of the boot is aligned with the heel section of the felt platform and the heel extension can be folded to fit against the heel region of the upper section of the boot.

DETAILED DESCRIPTION OF THE PREFERRED EMBODIMENTS

Figure 1:
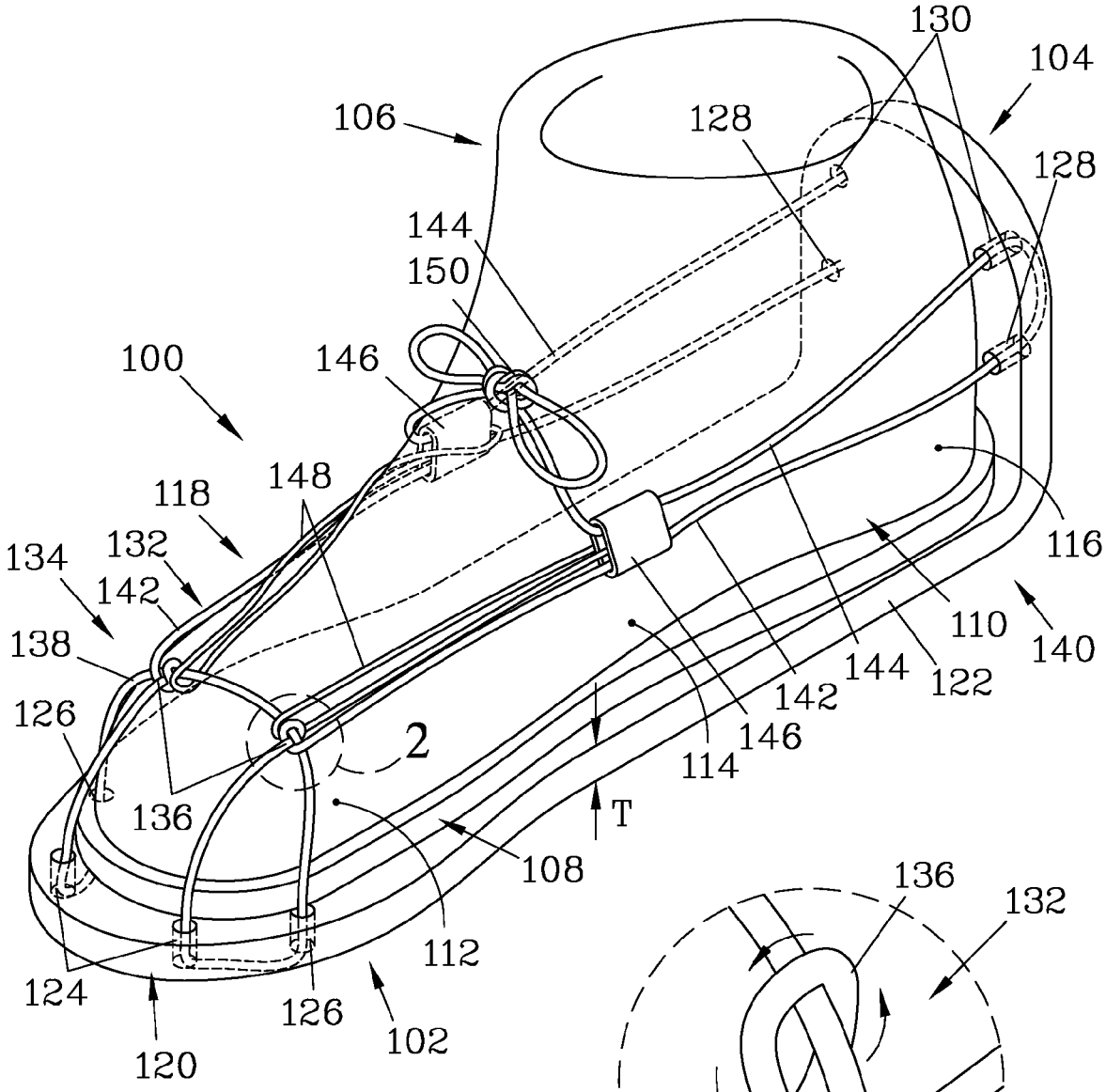
FIG. 1 is an isometric view of a traction device that forms one embodiment of the present invention, shown engaged with a hiking boot. The traction device has a felt platform with a toe section and a heel section, and a heel extension extending from the heel section. Cording is provided, which is threaded through two pairs of toe section passages provided in the toe section of the felt platform and through two pairs of heel extension passages provided in the heel extension. In this embodiment, a single length of cord is employed to lash the traction device to the boot. The cord is threaded through the passages and knotted around itself so as to form a toe lashing for securing the toe section of the felt platform to a toe region of the boot. The cord also forms a heel sling for securing the heel extension to a heel region of the boot. Segments of the cord that extend between one pair of the toe section passages and one pair of the heel extension passages form side stringers that have loops formed thereon. In this embodiment, the loops are formed from webbing and are attached to the toe lashing by loop tethers which are formed by additional pieces of cord. Segments of the cord which extend forward from the other pair of heel extension passages form cord extension segments, which pass through the loops. Means for cinching the cord extension segments between the loops are provided in this embodiment by a bow knot that ties the cord extension segments together.

FIG. 1 is an isometric view of a traction device 100 which forms one embodiment of the present invention. The traction device 100 has a felt platform 102 with a heel extension 104 attached thereto. In this embodiment, the felt platform 102 and the heel extension 104 are formed from a single piece of felt material. The felt material is preferably a polyester woven felt material, such as is commercially available, and has a thickness T that is preferably between about ⅛" and ½". The thinner felt materials are felt to be suitable when the traction device 100 is to be used on ski boots, while greater thickness materials are preferred for use with hiking boots in order to provide greater durability and shock absorption. ⅜" has been found to be a thickness well suited for use with hiking boots.

The traction device 100 is shown engaged with a boot 106 that has a sole section 108 and an upper section 110. The upper section 110 includes a toe region 112, an instep region 114, and a heel region 116. Cording 118 holds the felt platform 102 and the heel extension 104 in contact with the boot 106.

The felt platform 102 terminates in a toe section 120 and a heel section 122. The toe section 120 is provided with a first pair of toe section passages 124 and a second pair of toe section passages 126. The toe section passages (124, 126) in each pair are spaced apart from each other such that the toe region 112 of the boot 106 can reside substantially therebetween.

The heel extension 104 has a first pair of heel extension passages 128 and a second pair of heel extension passages 130. The heel extension passages (128, 130) in each pair are spaced apart from each other such that the heel region 116 of the boot 106 can reside substantially therebetween. To prevent the felt material from tearing, it is preferred for the passages (124, 126, 128, 130) to be spaced inward from the edge of the felt platform 102 and the heel extension 104. It is preferred for the passages (124, 126, 128, 130) to be spaced back from the edge such that the closest approach of the passages (124, 126, 128, 130) is at least about ¼" from the edge of the felt material when the felt material is about ⅜" thick.

The heel extension 104 should extend from the heel section 122 of the felt platform 102 a sufficient distance that the heel extension 104 can be folded to engage along a portion of the heel region 116 of the boot 106. Preferably, the heel extension 104 extends at least about 2½" from the felt platform 102 to position the heel extension passages (128, 130) sufficiently high to allow the cording to securely attach the heel extension 104 to the heel region 116. 2½" is felt to be a preferred minimum for use with a hiking boot. For use with ski boots, which are typically taller, it is felt that the heel extension 104 should extend somewhat further, and it is felt that the heel extension should preferably extend up to about 4" from the felt platform 102 for use with a ski boot.

The cording 118 for this embodiment is fabricated primarily from a single main cord 132 that is laced through the passages (124, 126, 128, and 130). The main cord 132 is threaded through the toe section passages (124, 126) and intertwined with itself such that, in combination with the toe section 120, it forms a toe lashing 134 for restrainably engaging the toe region 112 of the boot 106. In this embodiment, the main cord 132 is intertwined by knotting segments together with toe knots 136. To form the toe lashing 134, the main cord 132 is passed down through the second pair of toe section passages 126 to create a standing portion 138 that extends substantially across the toe section 120 between the second toe section passages 126. The main cord 132 is then brought forward on each side and passed through the corresponding one of the first toe section passages 124 on that side, and then brought rearward and intertwined with the standing portion 138 by tying the toe knot 136.

Figure 2:
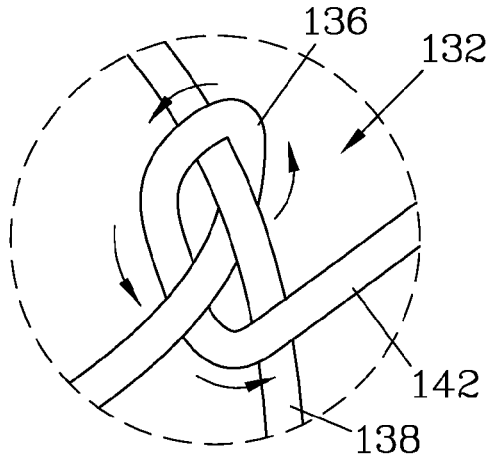
FIG. 2 is a detail view of the region 2 of FIG. 1, showing a preferred way to form a toe knot that secures one of the side stringers to a standing portion of the cord so as to form the toe lashing.

FIG. 2 illustrates a preferred form of the toe knot 136, which is simple to form and which can be readily adjusted. To form this toe knot 136, the main cord 132 is brought around the standing portion 138, passed under itself, and then brought above the standing portion 138, as indicated by the arrows in FIG. 2, to complete the toe knot 136. The main cord 132 is preferably formed from bonded rope such as is conventionally used for pull-starting cords for small power equipment such as lawn mowers, chainsaws, etc. This material has been found to have ideal durability, chemical resistance, and low elasticity. The main cord 132 preferably has a diameter of between about 3/16" to ¼", and a bonded rope having a diameter of 11/64" has been found effective.

The main cord 132 is also threaded through the heel extension passages (128, 130) such that, in combination with the heel extension 104, the main cord 132 forms a heel sling 140. The portion of the main cord 132 that extends from one of the first toe section passages 124 to the corresponding one of the first heel extension passages 128 forms a side stringer 142. The main cord 132 then traverses a portion of the heel extension 104 and passes through one of the second heel extension passages 130. In this embodiment, the main cord 132 is passed through the second heel extension passage 130 on the same side as the first heel extension passage 128. The portion of the main cord 132 that extends forward from the second heel extension passage 130 forms a cord extension segment 144.

Each of the side stringers 142 has a loop 146 provided thereon. Each loop 146 of the cording 118 of this embodiment is formed from webbing, and is restrained with respect to the toe lashing 134 by a loop tether 148 which ties between the loop 146 and the toe lashing 134 to limit the rearward position of the loop 146. Each of the cord extension segments 144 passes through one of the loops 146.

Means for cinching the cord extension segments 144 between the loops 146 are provided. In this embodiment, the means for cinching are provided by tying the cord extension segments 144 together with a bow knot 150. Because the rearward position of the loops 146 are limited, the bow knot 132 is positioned some distance from the ankle of the wearer for greater comfort, particularly when the traction device 100 is employed with low-cut boots or shoes. The loops 146 also serve to tension the side stringers 142 when the cord extension segments 144 are cinched, thereby drawing the felt platform 102 and the heel extension 104 securely against the boot 106. In this embodiment, the loops 146 are constrained by the loop tethers 148 so as to be positioned rearward of the toe lashing 134 by a distance that is about ⅓ of the length of the side stringers 142 so as to position the cinched portions of the cord extension segments 144 ahead of the ankle of the wearer. For example, for use with size 7 men's boots, it was found practical to have the loops positioned about 2½"-3" from the toe knots 136.

Figures 3, 4:
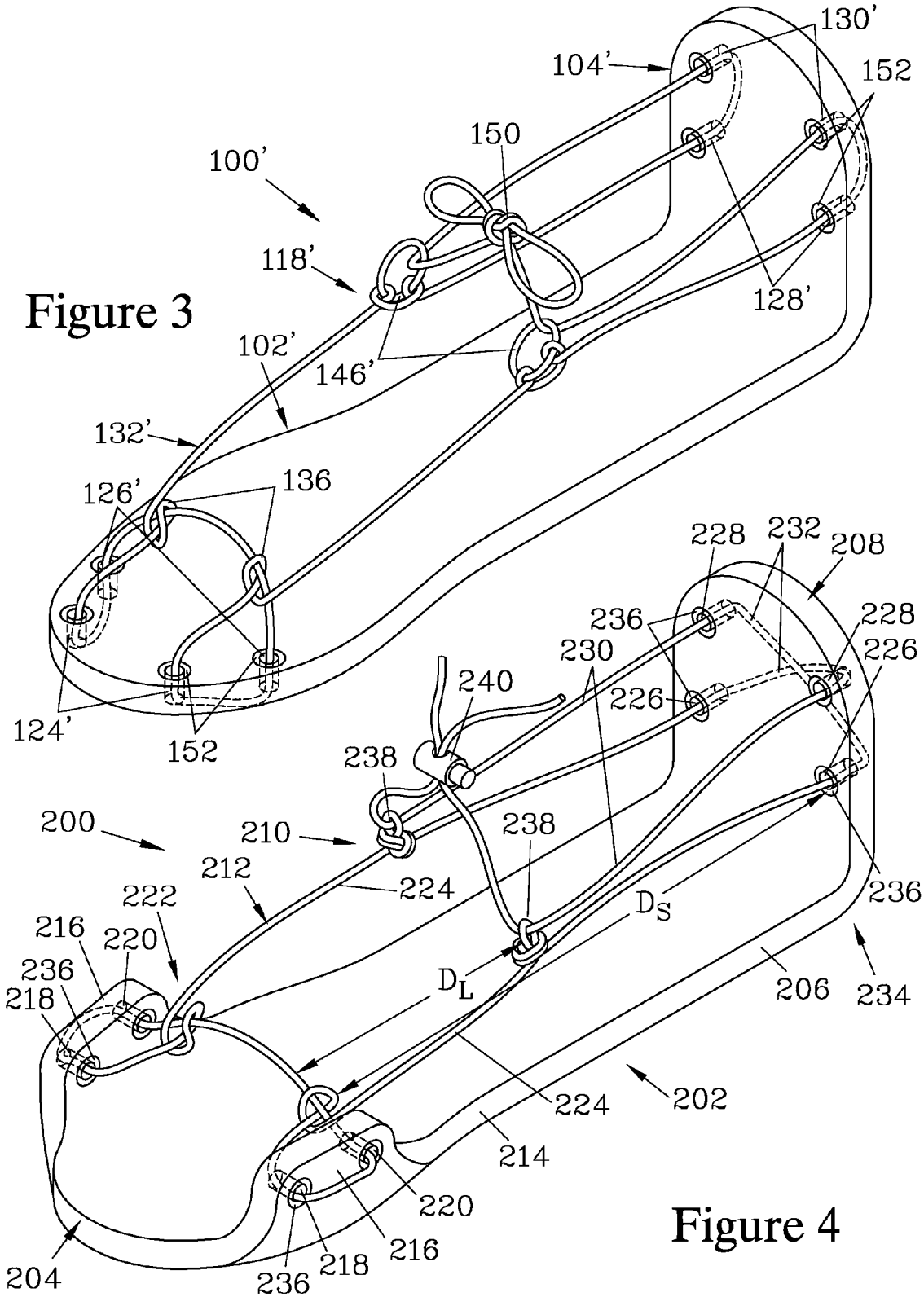
FIG. 3 is an isometric view of a traction device that forms another embodiment of the present invention, which shares many features in common with the embodiment shown in FIG. 1. In this embodiment, two pairs of toe section passages and two pairs of heel extension passages are provided with eyelets to prevent a cord from cutting into the felt material that forms a felt platform and a heel extension. This embodiment also employs the loops that are formed by rings attached to side stringers by knots.
FIG. 4 is an isometric view of a traction device that forms another embodiment of the present invention, which also employs a single length of cord. In this embodiment, the toe section is provided with ear extensions which protrude from a body of the felt platform; the toe section passages are located in the ear extensions, which position the toe section passages so as to reduce wear on the cord during use and to better cradle the toe region of the boot. In this embodiment, the cord traverses the heel extension as it extends between the side stringers and the cord extension segments, providing a more secure engagement of the heel extension with the heel region of the boot. This embodiment also employs loops which are formed on each side by tying a doubled portion of the cord with an overhand knot. A cord lock provides means for cinching the cord extension segments between the loops.

FIG. 3 is an isometric view of another embodiment of the present invention, a traction device 100' that is similar to the traction device 100 of FIG. 1, differing in that loops in this embodiment are formed by metal rings 146' that are knotted into a main cord 132' which forms the remainder of a cording 118' of the traction device 100'. The position of the bow knot 150 in this embodiment depends on where the rings 146' are tied into the main cord 132' with respect to the toe knots 136.

This embodiment also differs in that the passages (124', 126', 128', and 130') are provided with eyelets 152 that prevent the main cord 132' from cutting into the material of the felt platform 102' and the heel extension 104'. The eyelets 152 should have an inner diameter somewhat larger than the diameter of the main cord 132' to allow the main cord 132' to be readily threaded therethrough. For example, when the main cord 132' has a diameter of 11/64", it has been found practical for the eyelets 152 to have an inner diameter of 9/32".

FIG. 4 is an isometric view of another embodiment of the present invention, a traction device 200. The traction device 200 again has a felt platform 202 terminating in a toe section 204 and a heel section 206, and a heel extension 208 that attaches to the heel section 206 and is preferably formed integrally therewith. Cording 210 is provided to secure the felt platform 202 and the heel extension 208 to a boot (not shown). Again, the cording 210 employs a single cord 212.

The felt platform 202 has a body 214 and ear extensions 216 that protrude from the body 214 to provide outriggers in the toe section 204. Preferably, the ear extensions 216 protrude out from the body 214 by about 1"-1½". A first pair of toe section passages 218 and a second pair of toe section passages 220 are provided, and in this embodiment the toe section passages (218, 220) extend through the ear extensions 216. The cord 212 passes through the toe section passages (218, 220) and is intertwined with itself so as to form a toe lashing 222 in combination with the felt platform 202. The ear extensions 216 serve to raise the toe section passages (218, 220) so as to avoid rubbing of the cord 212 on the ground surface being traversed, thereby reducing wear on the cord 212.

Again, the cord 212 is formed with side stringers 224 that each extend between one of the first toe section passages 218 and a first heel extension passage 226 that extends through the heel extension 208. The cord 212 then substantially traverses the heel extension 208 before passing through a second heel extension passage 228 on the opposite side of the heel extension 208. The portion of the cord 212 extending forward from the second heel extension passage 228 is defined as a cord extension segment 230. The portions of the cord 212 that extend between each side stringer 224 and its associated cord extension segment 230 form cord heel segments 232, the cord heel segments 232 crossing over each other and each substantially traversing the heel extension 208. The cord 212 and the heel extension 208, in combination, provide a heel sling 234. Having the cord heel segments 232 substantially traverse the heel extension 208 allows the heel sling 234 to more securely engage the boot, and reduces wear on the heel extension passages (226, 228). Preferably, the toe section passages (218, 220) and the heel extension passages (226, 228) are provided with eyelets 236 to further reduce wear.

A loop 238 is provided on each of the side stringers 224. In this embodiment, each of the loops 238 is formed by knotting the cord 212 at the desired location. Preferably, the loops 238 are positioned on the side stringers 224 at a loop distance $D_L$ from the toe lashing 222 where $D_L$ measures between about 20% and 40% of a side stringer distance $D_s$ between the toe lashing 222 and the first heel extension passage 226 into which the side stringer 224 passes. One simple way to form the loop 238 is to bend a portion of the cord 212 against itself to form a bight and then to tie an overhand knot in this doubled section of the cord 212, with the portion of the bight that extends from the overhand knot providing the loop 238. The cord extension segments 230 each pass through one of the loops 238.

Means for cinching the cord extension segments 230 between the loops 238 are provided, so as to maintain a downward pressure on the boot. In this embodiment, the cord extension segments pass through a spring-loaded cordlock 240 that provides the means for cinching the cord extension segments 230. Such cordlocks are commonly used in outdoor apparel and equipment, and are commercially available from several sources.

Figure 5:
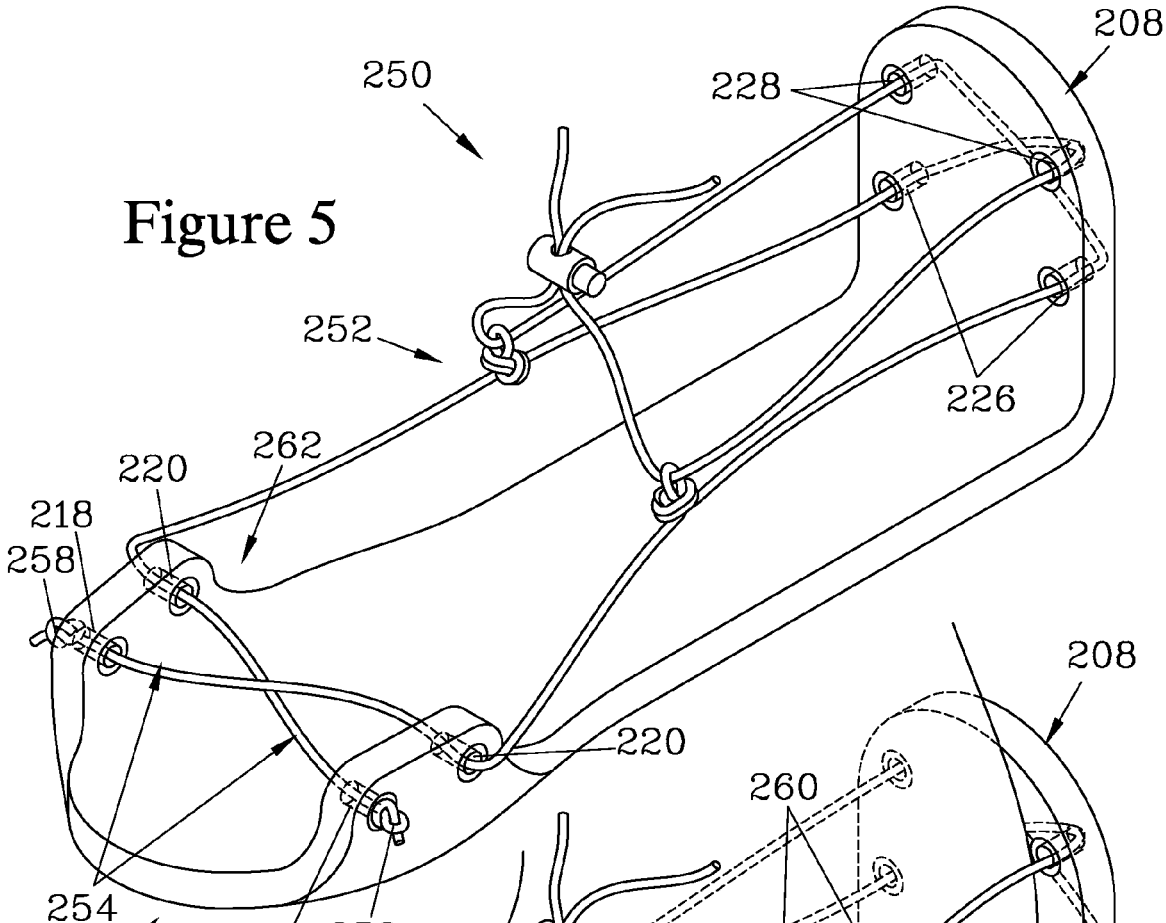
FIG. 5 is an isometric view of a traction device that forms another embodiment of the present invention, which employs the same felt platform and heel extension as the embodiment shown in FIG. 4, but which employs different cording. This embodiment employs two lengths of cord, each of which traverses the toe section of the felt platform as the cord extends between two toe section passages.
Figure 6:
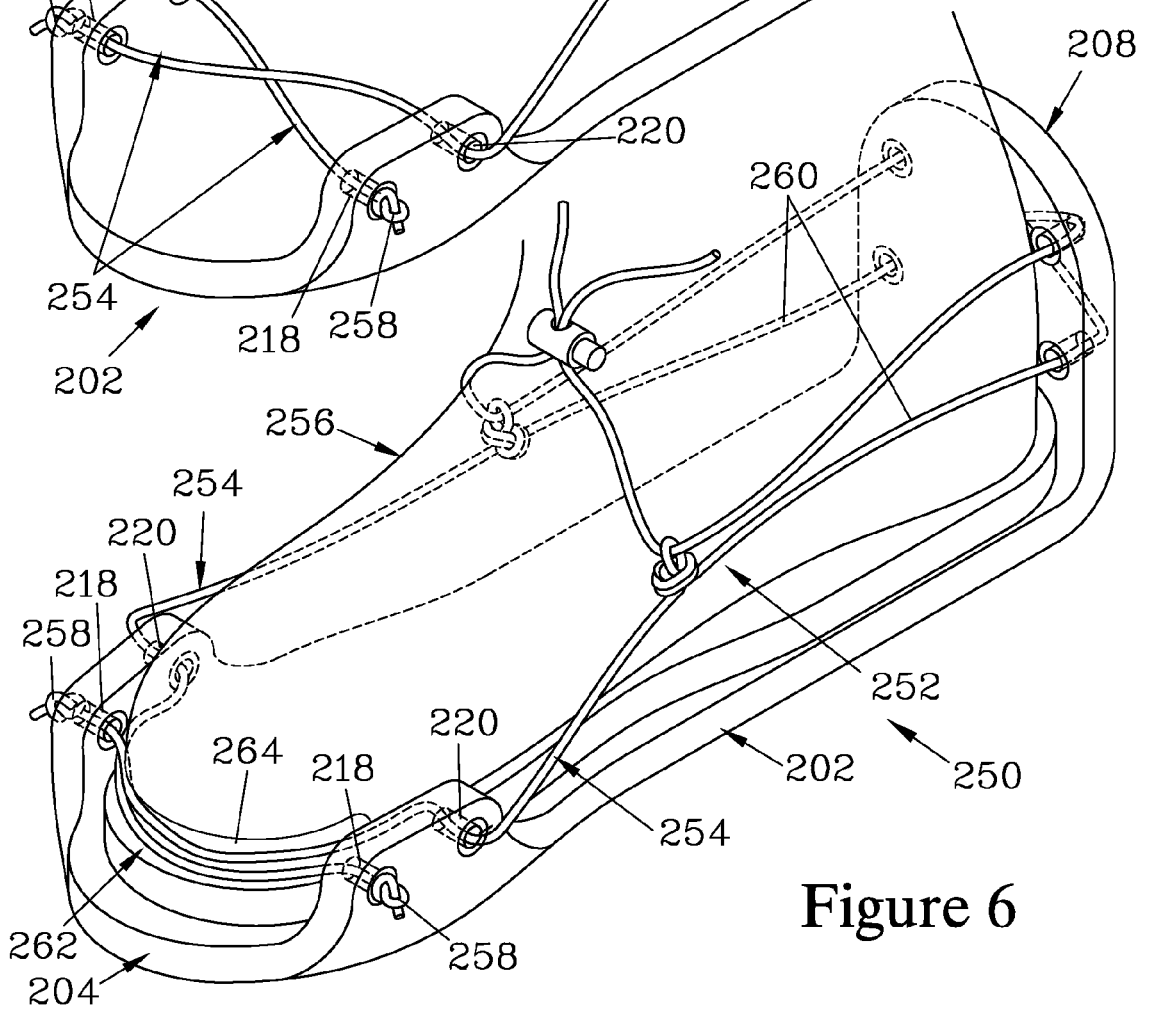
FIG. 6 is an isometric view of the traction device shown in FIG. 5, when engaged with a ski boot. In this application, the segments of the cord which traverse the toe section of the felt platform provide a stop that engages a toe groove in the ski boot to limit its forward position relative to the felt platform.

FIGS. 5 and 6 illustrate a traction device 250 that employs the same felt platform 202 and heel extension 208 as the embodiment shown in FIG. 4, but which employs cording 252 that has two cords 254, rather than a single length of cord. This embodiment, as illustrated in FIG. 5, has the cords 254 positioned to pass over the top section of the boot and grip the toe region of a hiking boot such as is shown in FIG. 1. FIG. 6 illustrates the position of the cords 254 when positioned to engage the toe region of a ski boot 256.

Each of the cords 254 is provided with a stopper knot 258, and is threaded through one of the first toe section passages 218. The cord 254 then substantially traverses the toe section 204 of the felt platform 202 and is threaded through the second toe section passage 220 on the other side. From there, the cord 254 extends rearward to the first heel extension passage 226 on the same side as the second toe section passage 220, forming a side stringer 260. The remainder of the cording 252 is formed similarly to the cording 210 discussed above.

The two cords 254 substantially traversing the toe section 204 between the toe section passages (218, 220), in combination with the felt platform 202, form a toe lashing 262 that is well suited for engaging a toe groove 264 such as is typically provided in the ski boot 256 for engaging a conventional ski binding on a ski (not shown). The toe lashing 262 is preferably adjusted to limit the position of the ski boot 256 such that the toe section 204 of the felt platform 202 extends at least about ½" forward of the ski boot 256 to protect the ski boot 256 from scuffing or other wear.

Figure 7:
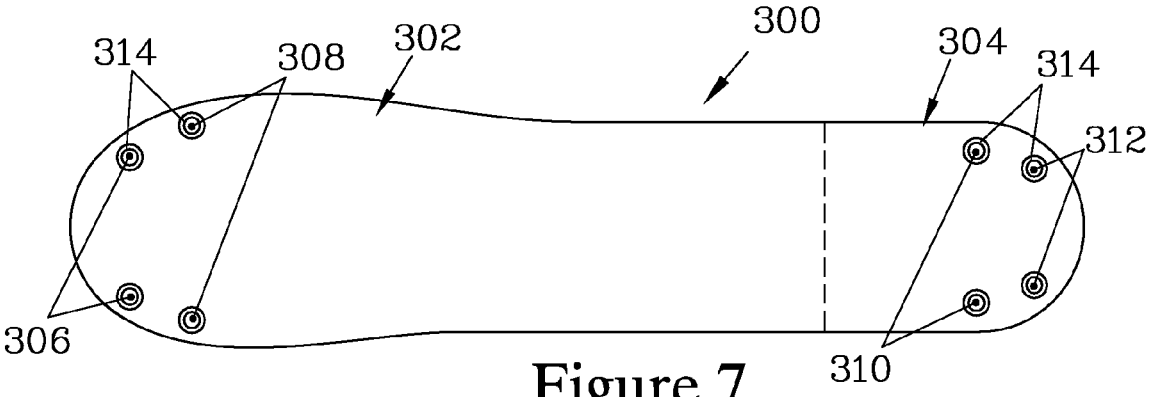
FIG. 7 is a plan view of a felt platform and attached heel extension that can be combined with cording to form a traction device such as shown in FIG. 3.

FIG. 7 is a plan view of a felt piece 300 that is configured to provide a felt platform 302 and a heel extension 304 which are similar to the felt platform 102' and the heel extension 104' shown in FIG. 3. The felt piece 300 is cut to shape, preferably by die-cutting, with two pairs of toe section passages (306, 308) and two pairs of heel extension passages (310, 312) formed therethrough. The toe section passages (306, 308) the heel extension passages (310, 312) can then be provided with eyelets 314. Cording (not shown) can then be threaded through the passages (306, 308, 310, 312) to form a traction device similar to the traction device 100'. The toe section passages (306, 308) and the heel extension passages (310, 312) are preferably set back from the periphery of the felt platform 300 such that the closest approach of the passages (306, 308, 310, 312) to the periphery will be greater than about ¼".

Figure 8:
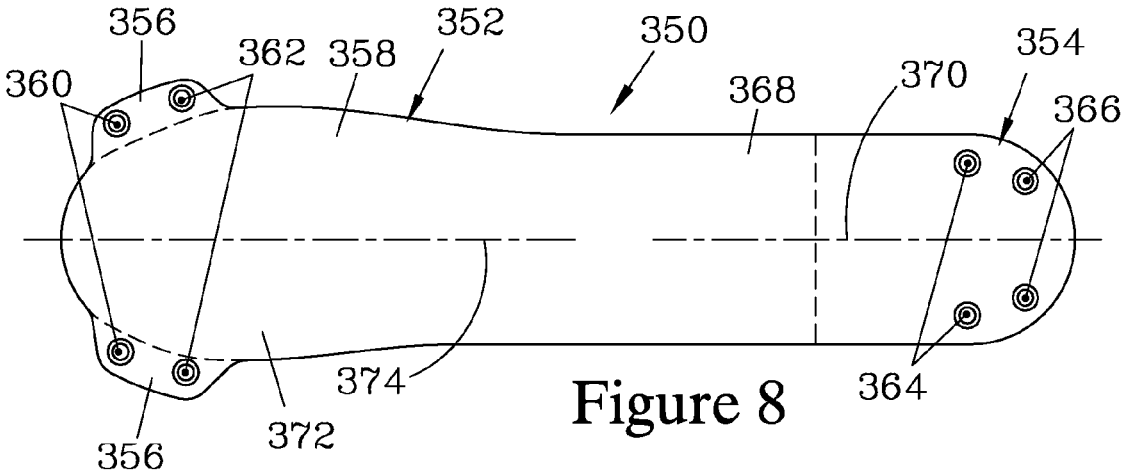
FIG. 8 is a plan view of another felt platform and attached heel extension that can be combined with cording to form a traction device of the present invention, similar to those shown in FIGS. 4-6, where the toe section has ear extensions. This felt platform and heel extension are particularly well suited for use with a ski boot, since the toe section has a toe section axis that is aligned with a heel and heel extension axis of the heel section of the felt platform and the heel extension.

FIG. 8 is a plan view of a felt piece 350 that is configured to provide a felt platform 352 and a heel extension 354 which are similar to the felt platform 202 and the heel extension 208 shown in FIGS. 4-6. The felt piece 350 is cut to shape with two ear extensions 356 that protrude from a felt platform body 358. Two pairs of toe section passages (360, 362) are formed through the ear extensions 356, and two pairs of heel extension passages (364, 366) are formed through the heel extension 354. Cording (not shown) can then be threaded through the passages (360, 362, 364, 366) to form a traction device similar to either the traction device 200 shown in FIG. 4 or the traction device 250 shown in FIGS. 5 and 6.

The felt platform 352 has a heel section 368 that is essentially symmetrically disposed about a heel-and-heel-extension axis 370, about which the heel extension 354 is also essentially symmetrically disposed. The felt platform 352 also has a toe section 372 which is essentially symmetrically disposed about a toe section axis 374. In this embodiment, the toe section axis 374 is co-linear with the heel-and-heel-extension axis 370, making the felt piece 350 well suited for forming a traction device for use with a ski boot.

Figure 9:
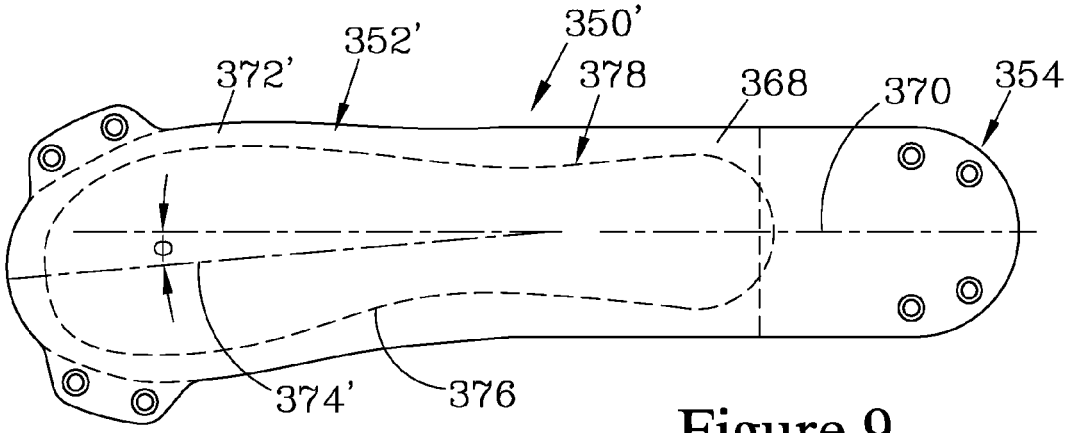
FIG. 9 is a plan view of another felt platform and attached heel extension that can be combined with cording to form a traction device similar to those shown in FIGS. 4-6. This felt platform and heel extension are particularly well suited for use with a hiking boot, having a toe section axis that is slightly inclined with respect to a heel and heel extension axis so as to more closely conform to the contours of a conventional hiking boot.

FIG. 9 is a plan view of a felt piece 350' that differs from the felt piece 350 in that it has felt platform 352' where a toe section 372' is evenly disposed about a toe section axis 374' that is inclined with respect to the heel-and-heel-extension axis 370. The toe section axis 374' is inclined with respect to the heel-and-heel-extension axis 370 by an angle Φ which preferably measures not more than about 5°, and more preferably about 3°. The inclination of the toe section axis 374' is such as to cant the toe section 372' towards an inner edge 376 of a sole section of a boot, represented in FIG. 9 by a sole section footprint 378. This configuration makes the felt piece 350' well suited for forming a traction device for use with a hiking boot, as the cant of the toe section 372' shapes the resulting traction device so as to better conform to the shape of such boots.

While the novel features of the present invention have been described in terms of particular embodiments and preferred applications, it should be appreciated by one skilled in the art that substitution of materials and modification of details obviously can be made without departing from the spirit of the invention.

What I claim is:

1. A traction device for a boot having a sole section and an upper section, the sole section having an arch region and being bounded by an inner edge and an outer edge and the upper section having a toe region, an instep region, and a heel region, the traction device comprising:

a felt platform terminating in a toe section and a heel section, said felt platform being configured such that the sole section of the boot will substantially reside on said felt platform, said toe section having a first pair and a second pair of toe section passages therethrough, each of said pairs of passages being spaced apart such that the toe region of the boot will substantially reside between each of said pairs of passages;

a heel extension attached to said heel section of said felt platform and extending a sufficient distance that said heel extension can be folded so as to bring said heel extension in contact with the heel region of the upper section of the boot, said heel extension having a first pair and a second pair of heel extension passages, said heel extension passages of each pair being spaced apart such that the heel region of the boot will substantially reside between each of said pair of heel extension passages;

cording sized to be threaded through said toe section passages and said heel extension passages, said cording, when so threaded, creating a toe lashing in combination with said toe section of said felt platform, and forming a heel sling in combination with said heel extension, said cording, when threaded through said passages, providing a pair of substantially parallel cord segments forming side stringers that each extend between one of said toe section passages and one of said heel extension passages, said cord further having a pair of cord extension segments which extend said cording beyond said heel extension passages, each of said side stringers having a loop formed thereon which, in service, resides beside the instep region of the boot, a portion of one of said cord extension segments passing through each of said loops; and means for cinching said cord extension segments between said loops about a portion of the boot, thereby providing a downward pressure on the boot so as to draw said felt platform into intimate contact with the sole of the boot.

2. The traction device of claim 1 wherein said loops are formed as integral parts of said side stringers.

3. The traction device of claim 2 wherein said toe section of said felt platform further comprises:

ear extensions protruding from each side of said toe section which serve as outriggers to said toe section of said felt platform, said toe section passages residing in said ear extensions.

4. The traction device of claim 3 further comprising:

an eyelet in each of said toe section passages and each of said heel extension passages.

5. The traction device of claim 4 wherein each of said loops is positioned along one of said side stringers such that a loop distance $D_L$ from said toe lashing to said loop is between 20% and 40% of a side string distance $D_S$ between said toe lashing and the one of said heel extension passages into which said side stringer passes.

6. The traction device of claim 5 wherein said means for cinching said cord extension segments about a portion of the boot further comprises:

a cord lock for releasably, lockably engaging both of said cord extension segments.

7. The traction device of claim 6 wherein said cord is formed from a single length of cord.

8. The traction device of claim 6 wherein said cord has a cord heel segment extending between each of said side stringers and the one of said cord extension segments that extends therefrom, said cord heel segments crossing over each other behind said heel extension.

9. The traction device of claim 8 wherein said felt platform has a thickness T of between about ⅛" and ½".

10. The traction device of claim 9 wherein said felt platform has a thickness T of about ⅜".

11. The traction device of claim 10 wherein said cord has a cord diameter of between about 3/16 and ¼", further wherein each of said loops has a loop diameter larger than said cord diameter and not larger than about ½".

12. The traction device of claim 4 wherein said heel section and said heel extension have a central heel-and-heel-extension axis and said toe section has a central toe section axis which is inclined with respect to said heel-and-heel-extension axis by an angle Φ, such inclination serving to cant said toe section toward the inner edge of the sole section of the boot.

13. The traction device of claim 12 wherein said angle Φ measures about 30°.

* * * * *